US010822934B1

(12) United States Patent
Yelundur

(10) Patent No.: US 10,822,934 B1
(45) Date of Patent: Nov. 3, 2020

(54) APPARATUS AND METHOD OF FOCUSED IN-SITU ELECTRICAL HEATING OF HYDROCARBON BEARING FORMATIONS

(71) Applicant: Rama Rau Yelundur, Houston, TX (US)

(72) Inventor: Rama Rau Yelundur, Houston, TX (US)

( * ) Notice: Subject to any disclaimer, the term of this patent is extended or adjusted under 35 U.S.C. 154(b) by 0 days.

(21) Appl. No.: 16/916,522

(22) Filed: Jun. 30, 2020

Related U.S. Application Data

(62) Division of application No. 15/563,467, filed as application No. PCT/US2016/025903 on Apr. 4, 2016, now Pat. No. 10,697,280.

(60) Provisional application No. 62/178,148, filed on Apr. 3, 2015.

(51) Int. Cl.
*E21B 43/24* (2006.01)
*E21B 36/04* (2006.01)

(52) U.S. Cl.
CPC ..... *E21B 43/2401* (2013.01); *E21B 36/04* (2013.01); *H05B 2214/03* (2013.01)

(58) Field of Classification Search
CPC ..... E21B 43/2401; E21B 36/04
See application file for complete search history.

(56) References Cited

U.S. PATENT DOCUMENTS 3,503,446 A 3/1970 Brandon
3,547,193 A 12/1970 Gill
3,848,671 A 11/1974 Kern
3,958,636 A 5/1976 Perkins
4,084,637 A 4/1978 Todd
4,127,169 A 11/1978 Tubin et al.
4,140,179 A 2/1979 Kasevich
(Continued)

OTHER PUBLICATIONS

International Search Report and Written Opinion for related PCT application PCT/US2016/025903 dated Aug. 11, 2016; pp. 1-9.

*Primary Examiner* — D. Andrews
(74) *Attorney, Agent, or Firm* — Bracewell LLP; Douglas W. Rommelmann

(57) ABSTRACT

A process and system for in-situ electrical heating of a hydrocarbon bearing formation includes a tool capable of being lowered down a well casing. The tool has a plurality of metal arms capable of extending radially within a secondary well casing. Each of the metal arms includes an injection electrode, a bucking electrode, and first and second monitoring electrodes. An insulating member is mounted to each metal arm. The insulating member is arranged and designed to make contact with the casing and prevent the metal arm from directly contacting the casing. A switch is provided that is capable of being electrically connected to the plurality of electrodes of one metal arm at a time. A logging cable having a plurality of wires connected at one end to the switch and a second end to instrumentation at the ground surface. The process for recovering hydrocarbons includes lowering the tool down a well casing to or near the hydrocarbon bearing formation and creating an equi-potential surface over at least the length of the tool and emanating outwardly of the well casing. A heat beam is developed by focusing the current of the injection and bucking electrodes to heat a region containing hydrocarbons, and then recovering hydrocarbons from the production well.

10 Claims, 6 Drawing Sheets

(56) References Cited

U.S. PATENT DOCUMENTS

| | | | | |
|---|---|---|---|---|
| 4,185,691 | A * | 1/1980 | Tubin | E21B 36/04 166/302 |
| RE30,738 | E | 9/1981 | Bridges et al. | |
| 4,345,979 | A | 8/1982 | Carpenter | |
| 4,444,255 | A | 4/1984 | Geoffrey | |
| 4,545,435 | A | 10/1985 | Bridges et al. | |
| 4,612,988 | A | 9/1986 | Segalman | |
| 4,926,941 | A | 5/1990 | Glandt et al. | |
| 5,046,559 | A | 9/1991 | Glandt | |
| 5,049,822 | A * | 9/1991 | Zoltan | G01V 3/20 324/367 |
| 5,060,726 | A | 10/1991 | Glandt et al. | |
| 5,543,715 | A | 8/1996 | Singer | |
| 5,621,845 | A | 4/1997 | Bridges et al. | |
| 7,042,225 | B2 | 5/2006 | Barber | |
| 7,046,010 | B2 | 5/2006 | Hu et al. | |
| 7,982,463 | B2 | 7/2011 | Snyder et al. | |
| 8,200,072 | B2 | 6/2012 | Vinegar et al. | |
| 8,261,832 | B2 | 9/2012 | Ryan | |
| 8,453,739 | B2 | 6/2013 | Parsche | |
| 2005/0134279 | A1 | 6/2005 | Hu et al. | |
| 2005/0199386 | A1 | 9/2005 | Kinzer | |
| 2009/0008079 | A1 * | 1/2009 | Zazovsky | E21B 36/04 166/60 |
| 2010/0163227 | A1 | 7/2010 | Tranquilla et al. | |
| 2013/0213637 | A1 | 8/2013 | Kearl | |

* cited by examiner

APPARATUS AND METHOD OF FOCUSED IN-SITU ELECTRICAL HEATING OF HYDROCARBON BEARING FORMATIONS

CROSS-REFERENCE TO RELATED APPLICATIONS

This application is a divisional application of U.S. application Ser. No. 15/563,467, filed Sep. 29, 2017, which is a 371 of PCT/US2016/025903 filed Apr. 4, 2016, which claims the benefit of U.S. Provisional Application Ser. No. 62/178,148 filed Apr. 3, 2015. Application Ser. No. 15/563,467, PCT/US2016/025903 and 62/178,148 are incorporated by reference herein for all purposes.

BACKGROUND OF THE INVENTION

1. Field of the Invention

The present invention relates generally to methods and systems for the production of hydrocarbons from subsurface formations.

2. Description of Related Art

Hydrocarbons have been discovered and recovered from subsurface formations for several decades. Over time, the production of hydrocarbons from these hydrocarbon wells diminishes and at some point require workover procedures in an attempt to increase the hydrocarbon production. Various procedures have been developed over the years to stimulate the oil flow from the subsurface formations in both new and existing wells.

It is well known that for every barrel of hydrocarbon that has been extracted from the earth since oil exploration began, there are at least two barrels of oil left behind. This is because the oil in the pore spaces in the formation adheres to the surface and increases the viscosity. Several efforts have been made to recover this oil. One approach has been to drill secondary or injection wells around the production well. High pressure steam, detergents, carbon dioxide and other gases are pumped into these secondary wells to push the oil. The results have been marginal and very expensive. Steam has shown promise. Steam can generate pressure and heat. The heat reduces the viscosity and the pressure pushes the oil towards the production well. However, water boils at higher temperatures under higher pressures. Steam generated at the surface and pumped down over thousands of feet is not able to flush out the hydrocarbons.

Recently, production of hydrocarbons has been enhanced by a technique known as fracking. Horizontal drilling holes of shallow diameter are drilled into shale formations. Tremendous pressure applied to the fluid in these holes shatters the shale to release the trapped hydrocarbons. To produce this pressure requires a large amount of energy and other resources.

There is a large amount of viscous hydrocarbons known as tar sands in different regions of the world estimated to rival moveable hydrocarbon estimates. Presently, these deposits are mined and brought to the surface where it is melted and distilled to produce useable products. Mining these deposits is environmentally bad and mining cannot be used to extract the deep hydrocarbons.

During the second world war, Germans in short supply of hydrocarbons discovered a technique called Fischer-Tropsch process to produce hydrocarbons from coal. This involves a large amount of heat. Mining these coal deposits is environmentally bad and mining cannot be used to extract the deep coal deposits.

In the oceans near the poles, scientists have discovered large amounts of hydrates. Hydrates are frozen gaseous hydrocarbons. To extract the hydrates requires a large amount of heat.

It is desirable to have methods and systems for the delivery of heat to produce hydrocarbons from subsurface formations that is environmentally clean and cost effective.

BRIEF SUMMARY OF THE INVENTION

An embodiment of the present invention can generate the same pressure in the horizontal holes as required during fracking, but at a fraction of the cost. An embodiment of the invention can deliver the large amount of heat needed to extract viscous hydrocarbons and hydrocarbons from hydrates and coal deposits while being environmentally clean and cost effective.

BRIEF DESCRIPTION OF THE DRAWINGS

So that the manner in which the above recited features, advantages and aspects of the embodiments of the present invention are attained and can be understood in detail, a more particular description of the invention, briefly summarized above, may be had by reference to the preferred embodiments thereof which are illustrated in the appended drawings, which drawings are incorporated as a part hereof.

It is to be noted however, that the appended drawings illustrate only typical embodiments of this invention and are therefore not to be considered limiting of its scope, for the invention may admit to other equally effective embodiments.

DESCRIPTION OF THE PREFERRED EMBODIMENTS OF THE INVENTION

On an equi-potential surface immersed in a conductive media, if an electric current is injected normally on one side of the equi-potential surface, the current will flow normally to the surface with the same cross-section as the injected current. It will maintain the same cross-section over a distance. This distance will depend upon the extent of the equi-potential surface, conductivity of the media, frequency of the current and the uniformity of the conductive media. This current will increase the temperature of the media over this distance due to the current flowing in the cross-section.

Any desired temperature can be obtained by controlling the magnitude and duration of the electrical current in the cross-section.

Figure 1:
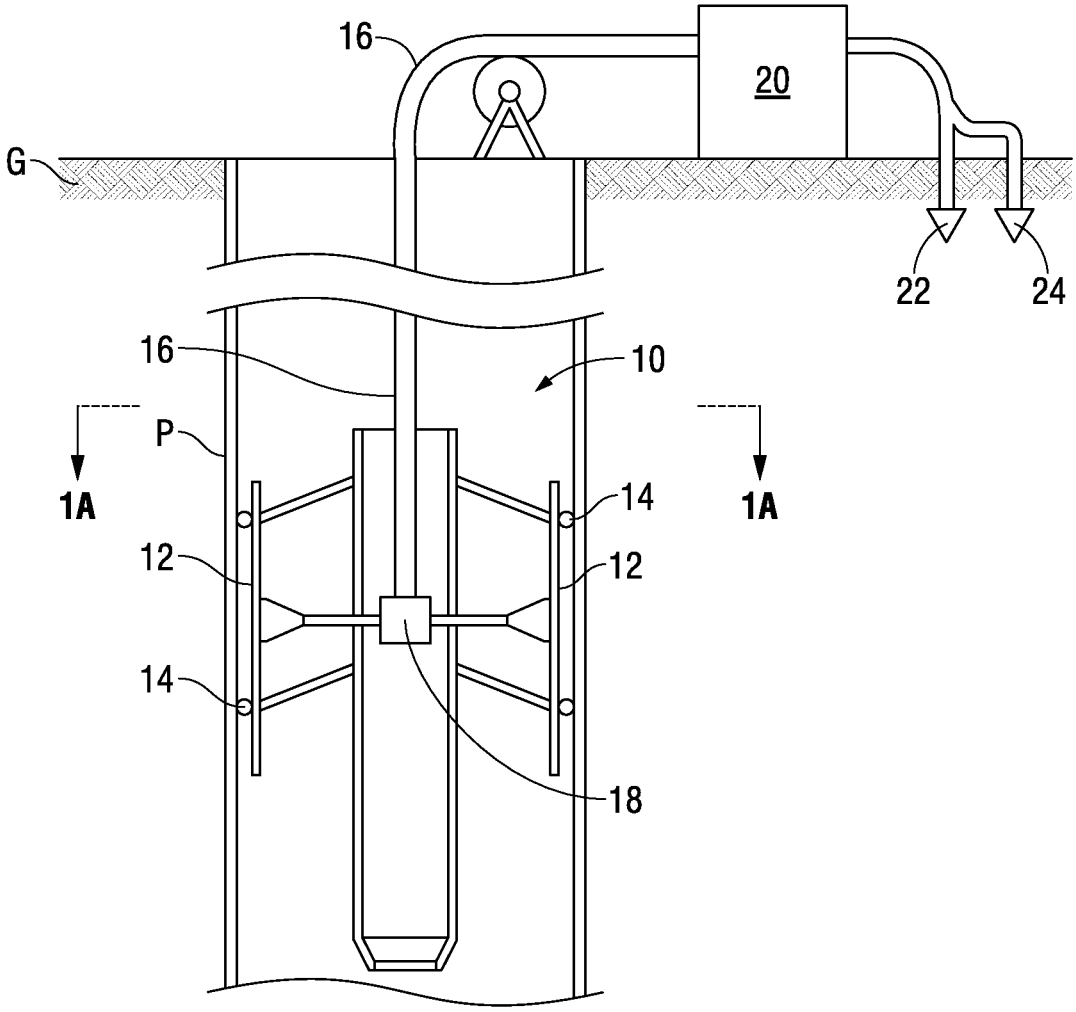
FIG. 1 is an elevation view in partial cross-section showing the tool of a preferred embodiment of the present invention inserted in a cased hole.
Figure 1A:
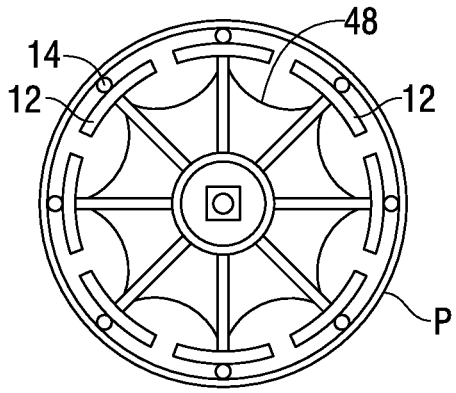
FIG. 1A is a view taken along lines 1A-1A in FIG. 1.

The present disclosure describes how to create this equi-potential surface and the heat beam in a conductive media. Consider a conductive metal pipe P buried in a conductive media. G such as the earth as shown in FIG. 1. A logging tool 10 with metal arms 12, preferably flexible metal arms, is lowered in the pipe P. Each metal arm 12 has insulating rollers 14 which make contact with the wall of the pipe P when the arms 12 are extended. The fully extended tool 10 in the metal pipe P is shown in FIG. 1. The arms 12 preferably extend like an umbrella and make contact with the wall of the pipe P through the non-conductive rollers 14. Preferably, there are enough arms 12 to cover the pipe circumference. In the case of a smaller diameter pipe P, the arms 12 overlap.

Figure 5:
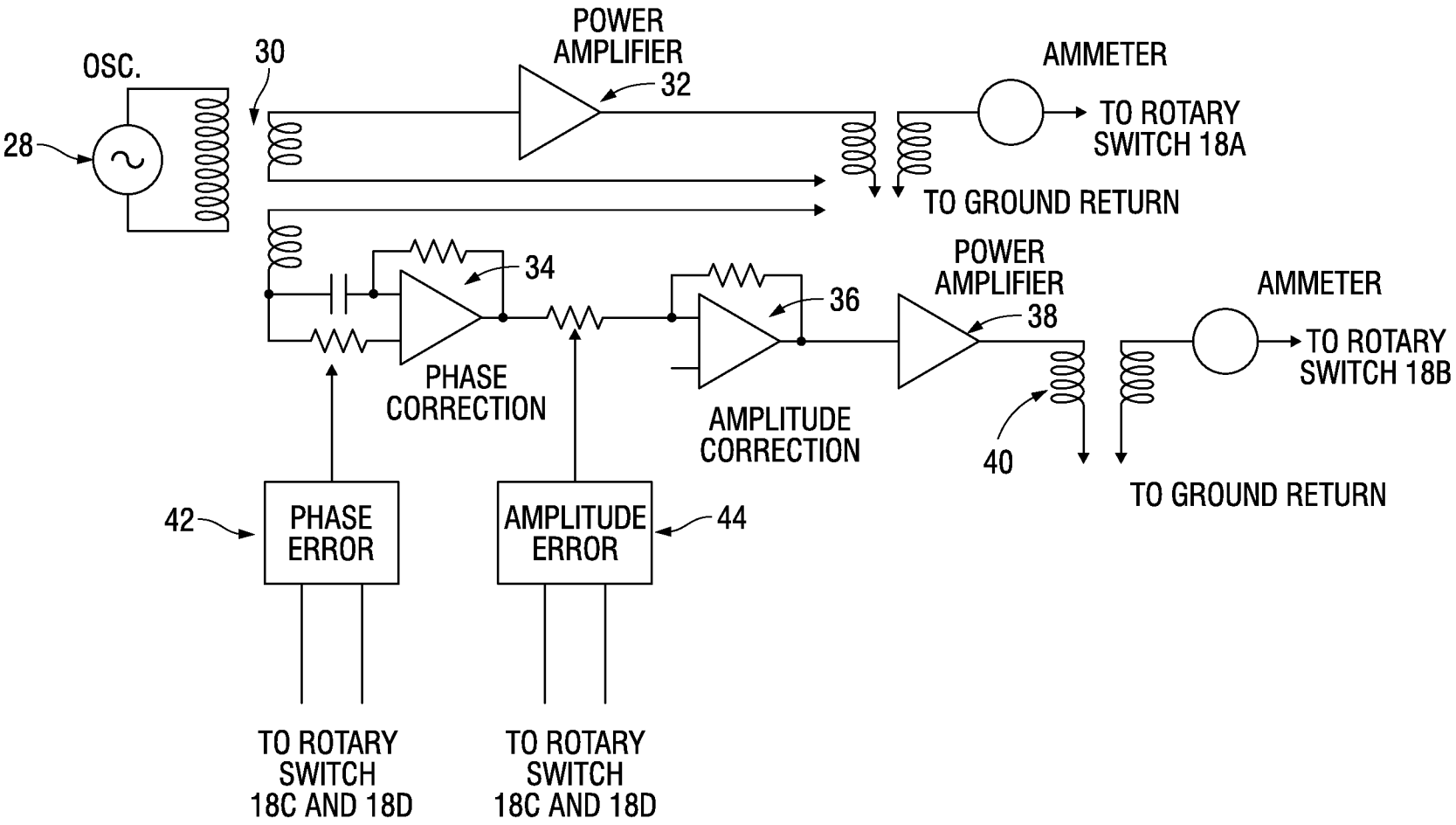
FIG. 5 is an electrical diagram of the system electronics according to a preferred embodiment of the invention.

Each arm 12 is connected with every other arm 12 by an electrical cable 48 so that they are all at the same potential. The logging cable 16 has four wires. The four wires of the logging cable 16 connect to a four pole rotary switch 18 shown in FIG. 3. The function of the rotary switch 18 is to connect the four electrodes of each arm 12 through the logging cable 16 to the instrumentation at the surface as shown in FIG. 5, one arm 12 at a time.

Figure 3:
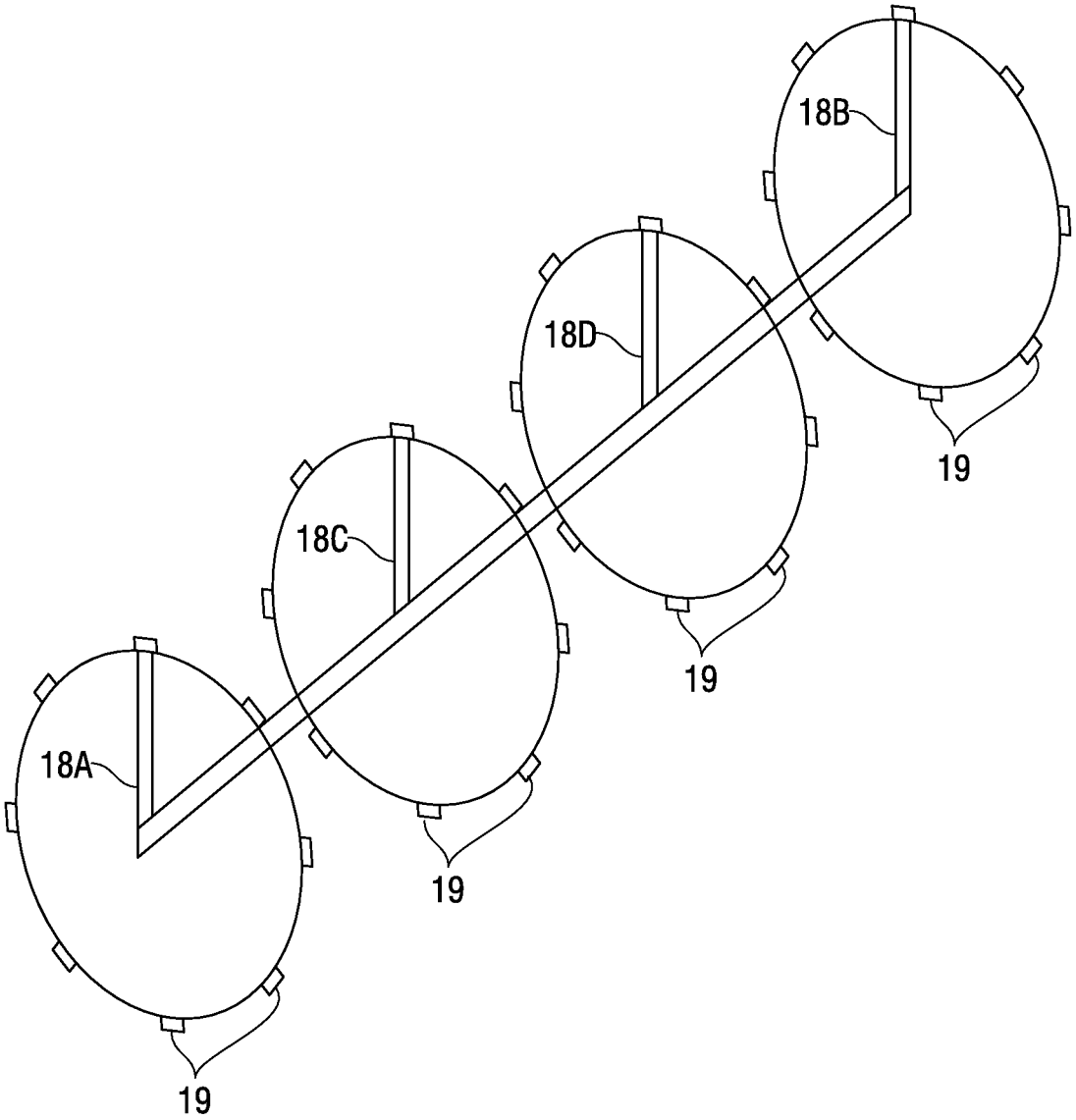
FIG. 3 is a functional diagram of a four pole rotary switch for connecting a logging cable to the electrodes on the individual metal arms.

The four poles of the rotary switch 18 are mechanically connected so that all the arms move together when they are rotated. Each of the four wires of the logging cable 16 connects to one of the central arms 18A-18D as shown in FIG. 3. The rotary switch 18 has as many positions as there are metal arms 12. The positions with the central arm 18A are connected by wire to all the arm injection electrodes. Similarly the positions with central arms 18B, 18C and 18D are connected by wire to all the bucking and monitor electrodes of all the arms. With the rotary switch 18 in any one position, all the electrodes in one metal arm 12 are connected to the instrumentation at the surface. The return electrodes 22, 24 of the injection and bucking currents at the surface are buried in the ground as shown in FIG. 1.

Figure 2:
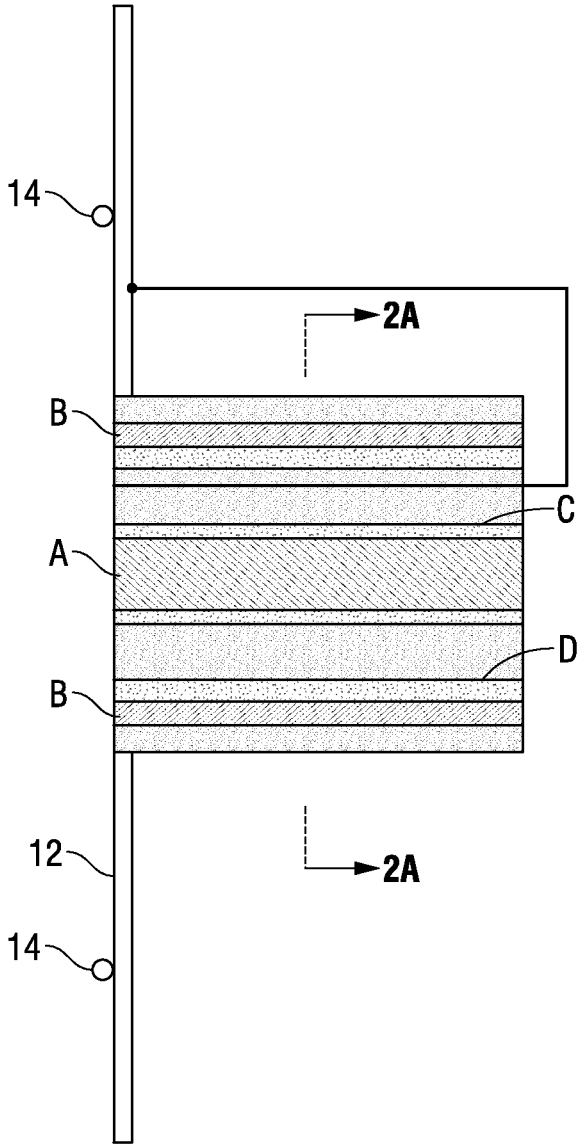
FIG. 2 is an enlarged cross-sectional view of a portion of a metal arm assembly and electrodes.
Figure 2A:
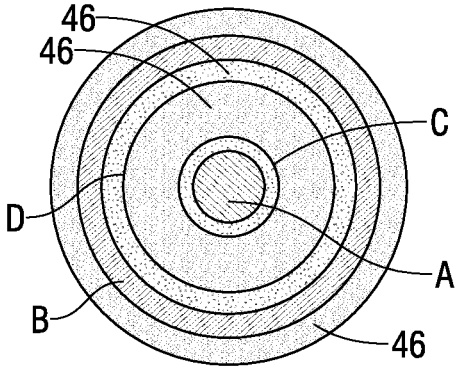
FIG. 2A is a view taken along lines 2A-2A in FIG. 2.
Figure 4:
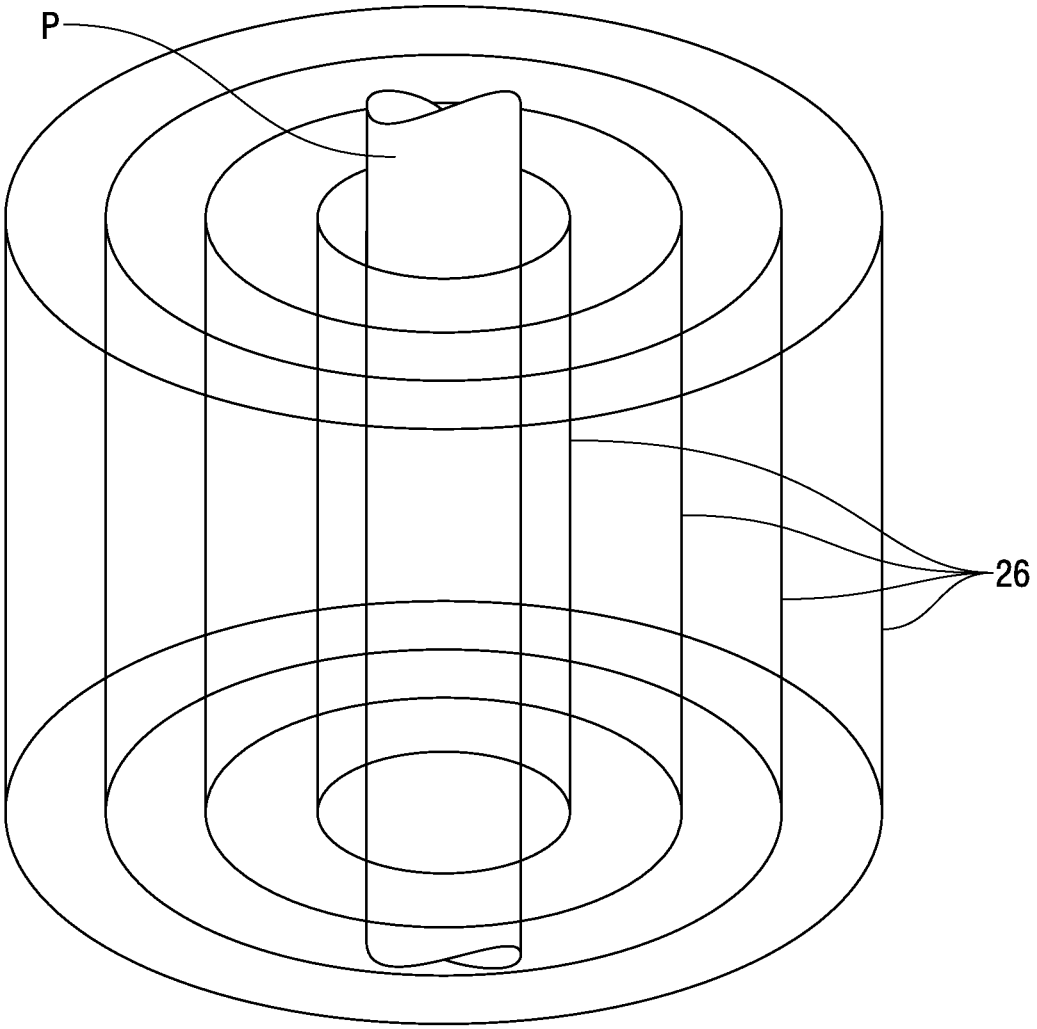
FIG. 4 is an illustration showing the equi-potential surfaces extending outwardly from the pipe.

Currents are injected into the metal arms 12 through the central injection electrode A and the surrounding co-axial bucking electrode B as shown in FIGS. 2 and 2A. The monitoring co-axial electrodes C and D lie between the electrodes A and B as shown in FIGS. 2 and 2A. A non-conducting material 46 wraps around electrodes A, C, D and B. The metal arm 12 is insulated from bucking electrode B but electrically connected to monitoring electrode D. The cross-sectional area of injection electrode A and bucking electrode B are made to be the same. The voltage drop along the current paths in a uniform media will be the same. Voltage between the monitoring electrodes C and D is monitored at the surface and can be controlled by varying the voltage of the bucking source. The bucking source voltage is adjusted until the voltage and phase differences between monitoring electrodes C and D goes to zero. When this occurs, an equi-potential surface 26 over the entire length of the tool 10 and beyond is created. This equi-potential exists for a large distance from the center of the pipe P. A sketch of the equi-potential surface 26 is shown in FIG. 4.

Figure 6:
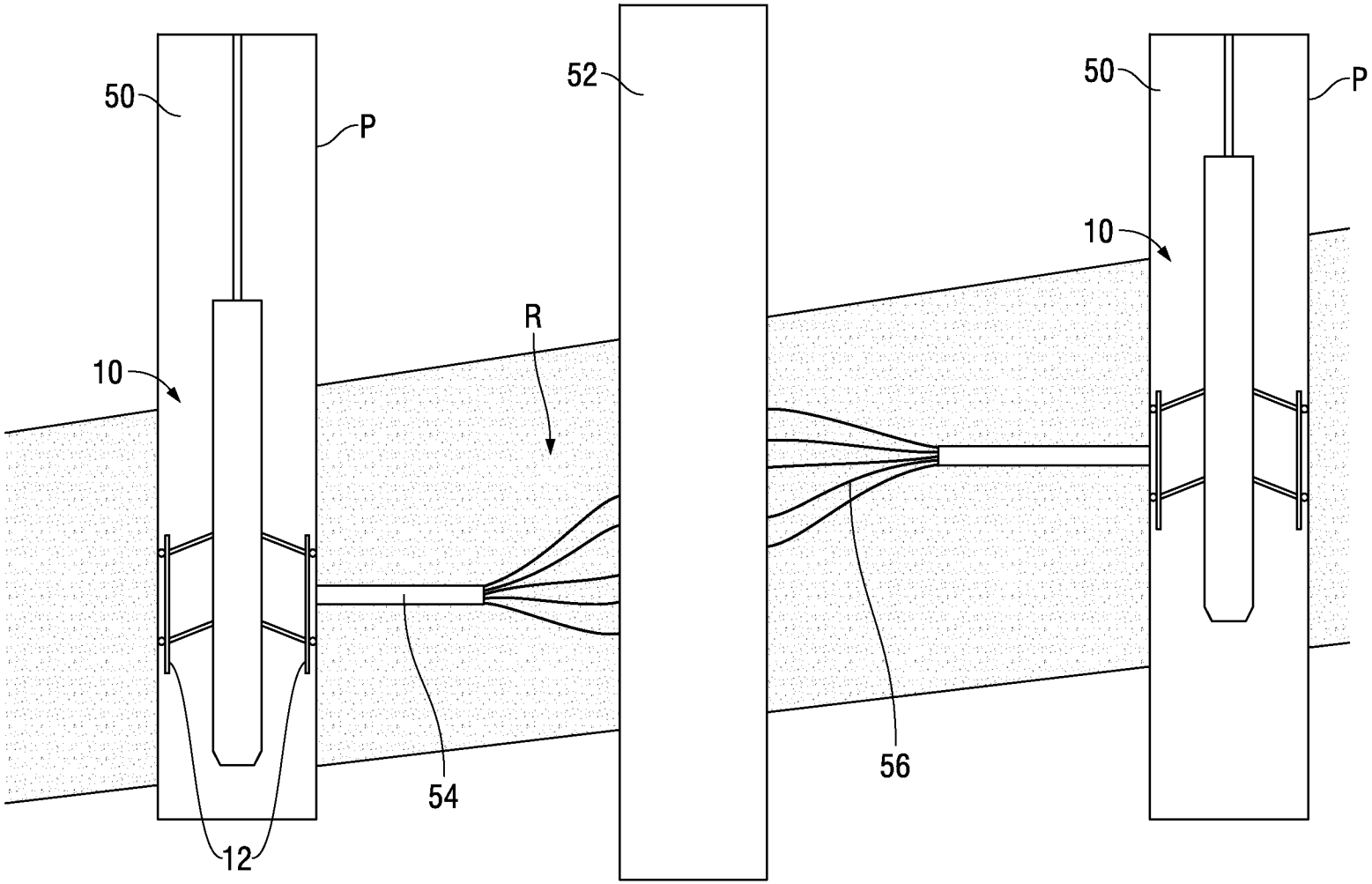
FIG. 6 is an illustration showing tools according to embodiments of the present invention used in injection wells surrounding a production well.

Depending on the length of the pipe P, the frequency of the signal, conductivity and uniformity of the media, equi-potential surfaces 26 exist parallel to the surface of the pipe P over a very large distance. The currents coming out of the electrodes A and B will traverse normally to the equi-potential surface 26 maintaining the same cross-section. If the voltage of electrodes A and B is raised to a level that current in the focused region increases significantly, a heat beam is created in that region as shown in FIG. 6. Since the current is uniform over this length, the temperature will be uniform. Any desired temperature can be obtained and maintained by adjusting the voltage of the oscillator.

The basic electronics is shown in FIG. 5. A low frequency oscillator 28 is fed to a transformer 30 with two similar secondary windings. One of the windings drives a power amplifier 32 and the output is fed to the injection electrode A. The other secondary winding is fed to a phase shift amplifier 34 and an amplitude adjustable amplifier 36. The output is fed to a power amplifier 38 whose output drives the bucking electrode B through an output transformer 40. Monitor electrodes C and D are connected to a phase detector 42 and differential amplitude detector 44. The signals from these detectors 42, 44 are fed to the phase shift amplifier 34 and amplitude adjustable amplifier 36 as shown in FIG. 5. This closed loop circuit will adjust the phase and amplitude of the signal feeding electrode B such that the voltage and phase difference between the monitoring electrodes C and D will be zero. When this is achieved, an equi-potential surface 26 will be created over the surface of the pipe P as shown in FIG. 4.

The currents flowing in the injection and bucking electrodes A and B respectively, are monitored. From it the resistivity of the formation in the focused beam path can be determined. The arms 12 of the tool 10 are similar to a dipmeter tool. By moving the tool 10 up and down and switching the power across all the arms, the currents from all the arms 12 can be logged with depth. By selectively switching the arms 12, the resistivity associated with each of the arms 12 at every depth can be determined. The dip in all directions can be obtained and hence the direction each arm 12 is pointing in the formation is determined. Knowing the porosity of the formation, the hydrocarbon saturation can be determined. Thus, allowing the operator at the surface to ascertain which arm 12 should be energized with high current to flush out the hydrocarbons. As the hydrocarbons flush out, resistivity of the formation increases and the amount of residual hydrocarbons remaining in the formation can be ascertained.

FIG. 6 is an illustration showing tools 10 according to embodiments of the present invention used in injection wells 50 surrounding a production well 52. With the tool 10 in one or more secondary or injection wells 50 lowered to the residual oil bearing region R and the return electrodes 22, 24 buried in the ground, the heat beam 54 can generate temperatures well above 300° C. to heat all around and push the oil into the production well 52. In each injection well 50, the heat beam 54 can be scanned vertically by moving the tool 10 up and down the casing P. The beam 54 can be scanned radially by switching the power between the arms 12. Thus, the entire hydrocarbon region R can be exposed to the heat beam 54. Through monitoring the currents, the rate and percentage of depletion can be determined. Hence the reservoir can be fully drained.

The length of the focused current of the heat beam 54 exists as long as the equi-potential surface 26 exists. Afterwards, the current spreads 56 and there is no longer any resistance to the current till it reaches the return electrode. FIG. 6 shows the current line in the region where it stays focused 54 and then where the current line spreads 56 after it gets unfocused.

There is a large amount of viscous hydrocarbons known as tar sands in different regions of the world estimated to rival moveable hydrocarbon estimates. Presently, these deposits are mined and brought to the surface where it is melted and distilled to produce useable products. Firstly, it is environmentally bad and secondly, it cannot be used to extract the deep hydrocarbons.

Using a production well 52 surrounded by several injection s 50, using horizontal drilling, holes can be drilled between these wells and the production wells. A mixture of conductive fluid and kerosene is pumped into these wells. Placing this device 10 in each of these wells at the depth where the horizontal holes have been drilled, we can heat the fluid and kerosene mixture to a very high temperature so as to melt the tar sands, reducing its viscosity and make it flow into the production well 52. This process is environmentally clean and also it can be used to extract oil from the tar sands at any depth.

The system 10 of the present invention can generate the same pressure in the horizontal holes as required during fracking, but at a fraction of the cost.

In the oceans near the poles, scientists have discovered large amounts of hydrates. Hydrates are frozen gaseous hydrocarbons. To extract it requires a large amount of heat. This device 10 would be ideal for this purpose.

During the second world war, Germans in short supply of hydrocarbons found a technique called Fischer-Tropsch process to produce hydrocarbons from coal. This involves a large amount of heat. Using this tool, we can generate hydrocarbons from coal at depths too deep for present day mining and also environmentally clean.

In view of the foregoing it is evident that the embodiments of the present invention are adapted to attain some or all of the aspects and features hereinabove set forth, together with other aspects and features which are inherent in the apparatus disclosed herein.

Even though several specific geometries are disclosed in detail herein, many other geometrical variations employing the basic principles and teachings of this invention are possible. The foregoing disclosure and description of the invention are illustrative and explanatory thereof, and various changes in the size, shape and materials, as well as in the details of the illustrated construction, may be made without departing from the spirit of the invention. The present embodiments are, therefore, to be considered as merely illustrative and not restrictive, the scope of the invention being indicated by the claims rather than the foregoing description, and all changes which come in the meaning and range of equivalence of the claims are therefore intended to be embraced therein.

I claim:

1. A system for in-situ electrical heating of a hydrocarbon bearing formation comprising:

a tool capable of being lowered down a well casing, the tool comprising:

a plurality of metal arms radially extendible within the well casing, each of the plurality of metal arms including an injection electrode, a bucking electrode, and first and second monitoring electrodes;

at least one roller mounted to each metal arm, the at least one roller arranged and designed to make contact with the casing; and a switch, the switch capable of being electrically connected to the plurality of electrodes of one metal arm at a time;

a logging cable having a plurality of wires, one end of the logging cable connected to the switch and a second end of the logging cable connected to instrumentation at the ground surface;

an injection voltage source electrically connected to the switch; and a bucking voltage source electrically connected to the switch, wherein for each metal arm, the switch has a separate position in which the injection voltage source feeds the injection electrode and the bucking voltage source feeds the bucking electrode.

2. The system of claim 1, wherein the switch is controlled at the ground surface.

3. The system of claim 1, wherein for each metal arm:

the injection electrode is central;

the first monitoring electrode surrounds and is coaxial with the injection electrode;

the second monitoring electrode surrounds and is coaxial with the first monitoring electrode; and the bucking electrode surrounds and is coaxial with the second monitoring electrode, wherein a non-conducting material electrically separates each of the electrodes from one another.

4. The system of claim 3, wherein for each metal arm, the second monitoring electrode is electrically connected to the metal arm.

5. The system of claim 3, wherein for each metal arm, the injection electrode and the bucking electrode have cross-sectional areas that are substantially equal.

6. The system of claim 3, wherein for each metal arm the first monitoring electrode is arranged and designed to monitor the voltage at the injection electrode; and the second monitoring electrode is arranged and designed to monitor the voltage at the bucking electrode.

7. The system of claim 6, further comprising:

an amplitude adjustable amplifier arranged and designed to adjust the voltage amplitude of the bucking voltage source feeding the bucking electrode such that the voltage amplitude difference between the first and second monitoring electrodes is zero.

8. The system of claim 7, further comprising:

a phase shift amplifier arranged and designed to adjust the voltage phase of the bucking voltage source feeding the bucking electrode such that the voltage phase difference between the first and second monitoring electrodes is zero.

9. The system of claim 3, further comprising:

a phase shift amplifier arranged and designed to adjust the voltage phase of the bucking voltage source feeding the bucking electrode such that the voltage phase difference between the first and second monitoring electrodes is zero.

10. The system of claim 9, further comprising:

an amplitude adjustable amplifier arranged and designed to adjust the voltage amplitude of the bucking voltage source feeding the bucking electrode such that the voltage amplitude difference between the first and second monitoring electrodes is zero.

* * * * *